US009370687B2

(12) United States Patent
Hao

(10) Patent No.: US 9,370,687 B2
(45) Date of Patent: Jun. 21, 2016

(54) FLATTENED TREADMILL

(71) Applicant: Dyaco International Inc., Taipei (TW)

(72) Inventor: Kuo-Wo Hao, Taipei (TW)

(73) Assignee: Dyaco International Inc., Taipei (TW)

( * ) Notice: Subject to any disclaimer, the term of this patent is extended or adjusted under 35 U.S.C. 154(b) by 36 days.

(21) Appl. No.: 14/532,948

(22) Filed: Nov. 4, 2014

(65) Prior Publication Data

US 2015/0126336 A1 May 7, 2015

(30) Foreign Application Priority Data

Nov. 6, 2013 (TW) ..... 102220737 U

(51) Int. Cl.
*A63B 22/02* (2006.01)

(52) U.S. Cl.
CPC ..... *A63B 22/0235* (2013.01); *A63B 2210/00* (2013.01)

(58) Field of Classification Search
CPC ..... A63B 22/02; A63B 22/0235; A63B 2210/50; A63B 22/0023; A63B 21/225; A63B 22/0056; A63B 21/154; A63B 22/0214; A63B 22/0242; A63B 2225/09; A63B 21/00069; A63B 21/0053; A63B 21/157; A63B 2225/093; A63B 22/00; A63B 21/0058; A63B 22/0015; A63B 22/0046; A63B 22/0048; A63B 22/0257; A63B 2071/009; A63B 2071/025; B65G 15/00; B65G 13/06
USPC ..... 482/54
See application file for complete search history.

(56) References Cited

U.S. PATENT DOCUMENTS 2,727,398 A * 12/1955 Bowen, Jr. ..... F16H 9/12 474/27
2,969,768 A * 1/1961 Grant ..... A01K 15/027 119/700
3,689,066 A * 9/1972 Hagen ..... A63B 22/02 198/811
4,566,689 A * 1/1986 Ogden ..... A63B 22/0023 474/115
4,792,134 A * 12/1988 Chen ..... A63B 22/0023 474/27
4,944,713 A * 7/1990 Salerno ..... A63B 22/02 198/330
5,000,440 A * 3/1991 Lynch ..... A63B 21/0615 482/112
5,336,144 A * 8/1994 Rodden ..... A63B 22/02 482/51
5,382,207 A * 1/1995 Skowronski ..... A63B 22/0023 198/807
5,484,362 A * 1/1996 Skowronski ..... A63B 22/0023 482/51
5,595,556 A * 1/1997 Dalebout ..... A63B 21/015 482/118
5,618,245 A * 4/1997 Trulaske ..... A61B 5/0002 482/54
6,045,490 A * 4/2000 Shafer ..... A63B 22/02 482/51

(Continued)

*Primary Examiner* — Steve R Crow
*Assistant Examiner* — Andrew S Lo
(74) *Attorney, Agent, or Firm* — Donald E. Stout; Stout, Uxa & Buyan, LLP

(57) ABSTRACT

An embodiment of this invention discloses a flattened treadmill comprising a conveyer belt and two decorating bars respectively arranged at a side of the conveyer belt. The conveyer belt and the decorating bars have the same elevation resulting in the flattened treadmill. In another embodiment, the flattened treadmill further comprising a motor housing, in which the elevation of the motor housing has also the same elevation as the conveyor belt.

8 Claims, 4 Drawing Sheets

(56) References Cited

U.S. PATENT DOCUMENTS 6,328,676 B1 * 12/2001 Alessandri ..... A63B 22/02 482/54
6,436,008 B1 * 8/2002 Skowronski ..... A63B 22/0023 482/51
6,478,720 B1 * 11/2002 Barker ..... A63B 22/0235 482/51
6,764,430 B1 * 7/2004 Fencel ..... A63B 22/0257 482/51
6,893,382 B1 * 5/2005 Moon ..... A63B 21/154 482/51
7,357,758 B2 * 4/2008 Polk, III ..... A63B 22/0023 482/54
7,618,352 B1 * 11/2009 Wei ..... A63B 22/0257 198/788
2002/0151413 A1 * 10/2002 Dalebout ..... A63B 22/02 482/54
2003/0139259 A1 * 7/2003 Kuo ..... A63B 22/02 482/54
2005/0202936 A1 * 9/2005 Ota ..... A63B 22/0235 482/54
2006/0142124 A1 * 6/2006 Lo ..... A63B 22/0023 482/54
2008/0020907 A1 * 1/2008 Lin ..... A61H 1/005 482/54
2008/0312048 A1 * 12/2008 Cassano ..... A63B 22/0235 482/54
2009/0197743 A1 * 8/2009 Schmidt ..... A63B 21/0058 482/52
2012/0165162 A1 * 6/2012 Lu ..... A63B 22/0235 482/54
2013/0123073 A1 * 5/2013 Olson ..... A63B 22/02 482/54
2014/0087922 A1 * 3/2014 Bayerlein ..... A63B 22/0235 482/54
2014/0274576 A1 * 9/2014 Beard ..... A63B 22/0235 482/54
2014/0274577 A1 * 9/2014 Beard ..... A63B 21/157 482/54
2014/0274579 A1 * 9/2014 Olson ..... A63B 22/0235 482/54

* cited by examiner

FLATTENED TREADMILL

CROSS-REFERENCE TO RELATED APPLICATIONS

The entire contents of Taiwan Patent Application. No. 102220737, filed on Nov. 6, 2013, from which this application claims priority, are expressly incorporated herein by reference.

BACKGROUND OF THE INVENTION

1. Field of the Invention

The present invention relates to a treadmill, and more particularly relates to a treadmill with a flat configuration.

2. Description of Related Art

Nowadays, people tend to lack adequate exercise due to busy lifestyles. To the extent running has become popular as a simple and effective means for squeezing physical activity into a tight schedule, it is not always practicable.

FIG. 1 is a cross-section view showing a conventional treadmill 1. The conventional treadmill 1 has a running belt 12 allowing a user to walk or run in place. Two securing bars 11 typically made of aluminum are arranged at a left side and a right side of the running belt 12, respectively. The operator can step the securing bars when the running belt 12 is at a rest condition. A plate 15 is arranged below the running belt 12 to support the running belt 12. The securing bars 11 are arranged at a frame 13, which has several buffering pad 14 to absorb the force of the running belt 12 and the plate 15. A screw 17 is used to fix the plate 15 and the buffering pad 14. In addition, some lateral bars 16 are spaced at interval between the two securing bars 11 and the screw 17 fixes the plate 15 with the lateral bar 16 and the buffering pad 14.

The securing bars 11 are arranged on the plate 12 and at two sides of the running belt 12. For long-term reliability, the securing bars 11 are higher than the running belt 12, i.e., the securing bars 11 having an elevation higher than the elevation of the running belt 12. When the running belt 12 is operated, the operator usually kicks the elevated securing bars 11 and thus stumbles on the running belt 12.

In addition, an end of running belt 12 of the conventional treadmill 1 typically has a motor and a wheel assembly (not shown) for driving a front roller and a rear roller under the running belt 12, so as to drive the running belt 12 to rotate. Due to space limitation, a motor housing 18 to cover those elements has an elevation higher than the elevation of the running belt 12. Furthermore, the elevation of the securing bars 11 could be higher so as to match the protruded motor housing 18, and the further protruded securing bars 11 is dangerous for the operator.

SUMMARY OF THE INVENTION

In one general aspect, the present invention relates to treadmills, and more particularly relates to a treadmill with a flat configuration.

In an embodiment of the present invention, a flattened treadmill is provided with a conveyor belt, two decorating bars, a supporting plate, a frame, a plurality of supporting rods, a plurality of buffering pads, a plurality of first fastening members, and a plurality of second fastening members. The endless conveyor belt allows a user for walking or running in the same place. The two decorating bars are arranged at a right and a left side of the conveyor belt respectively and have an elevation same as an elevation of the conveyor belt. The supporting plate is arranged below the conveyor belt to support the conveyor belt. The two decorating bars are arranged on the frame. The supporting rods are horizontally spaced at intervals below the supporting plate and inside of the frame. The buffering pads are arranged below the supporting rods. The first fastening members fix the supporting rods and the buffering pads. The second fastening members fix the supporting plate and the supporting rods.

In an embodiment, the supporting plate is made of wood or composite wood.

In an embodiment, the frame comprises at least a vertical portion and at least a horizontal portion.

In an embodiment, the first fastening members fix the supporting rods with the buffering pads and the horizontal portion.

In an embodiment, the supporting rods are not fixed with the frame.

In an embodiment, the two decorating bars are made of aluminum.

In an embodiment, the first fastening members and the second fastening members comprise screw and nut.

In an embodiment, the flattened treadmill further comprises a flat housing arranged at an end of the flattened treadmill and having an elevation same as the elevation of the conveyor belt.

In an embodiment, the flat housing covers at least some components of a driving system.

In an embodiment, the driving system drives the conveyor belt to rotate and comprises a front roller, a motor, a first wheel, a second wheel, and a medium wheel mechanism. The front roller is arranged under the conveyor belt and is surrounded by the conveyor belt. The motor has an elevation equal to or under than an elevation of the conveyor belt. The first wheel couples with the motor and has an elevation equal to or under than the elevation of the conveyor belt. The second wheel is arranged at a first end of the front roller and has a diameter equal to or smaller than a diameter of a second end of the front roller. The medium wheel mechanism couples with the first wheel and the second wheel. Whereby the motor drives the first wheel to rotate, the first wheel drives the medium wheel mechanism rotating, and the medium wheel mechanism drives the second wheel and the front roller rotating and thus causing the rotation of the conveyor belt.

DETAILED DESCRIPTION OF THE PREFERRED EMBODIMENT

Figure 1:
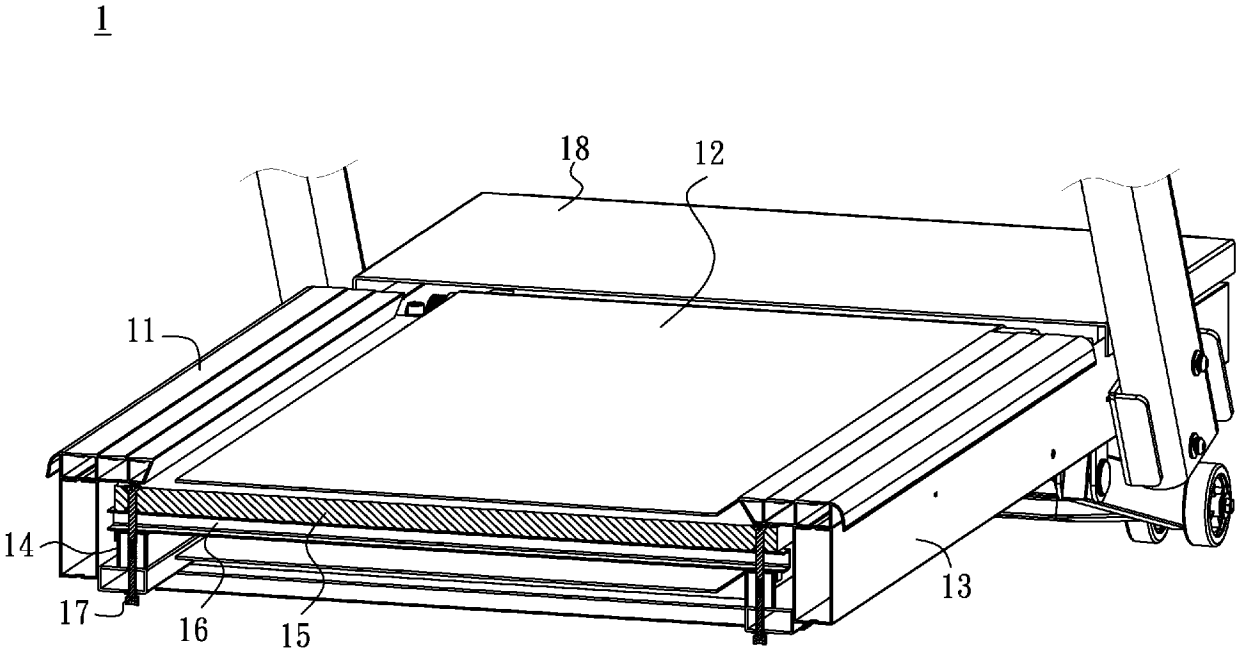
FIG.1(Prior Art)
FIG. 1 is a partially enlarged cross-sectional view showing a conventional treadmill.

Embodiments of the invention are now described and illustrated in the accompanying drawings, instances of which are to be interpreted to be to scale in some implementations while in other implementations, for each instance, not. In certain aspects, use of like or the same reference designators in the drawings and description refers to the same, similar or analogous components and/or elements, while according to other implementations the same use should not. While the invention will be described in conjunction with these specific embodiments, it will be understood that it is not intended to limit the invention to these embodiments. On the contrary, it is intended to cover alternatives, modifications, and equivalents as may be included within the spirit and scope of the invention as defined by the appended claims. In the following description, numerous specific details are mechanism forth in order to provide a thorough understanding of the present invention. The present invention may be practiced without some or all of these specific details. In other instances, well-known process operations and components are not described in detail in order not to unnecessarily obscure the present invention. While drawings are illustrated in detail, it is appreciated that the quantity of the disclosed components may be greater or less than that disclosed, except where expressly restricting the amount of the components.

Figure 2:
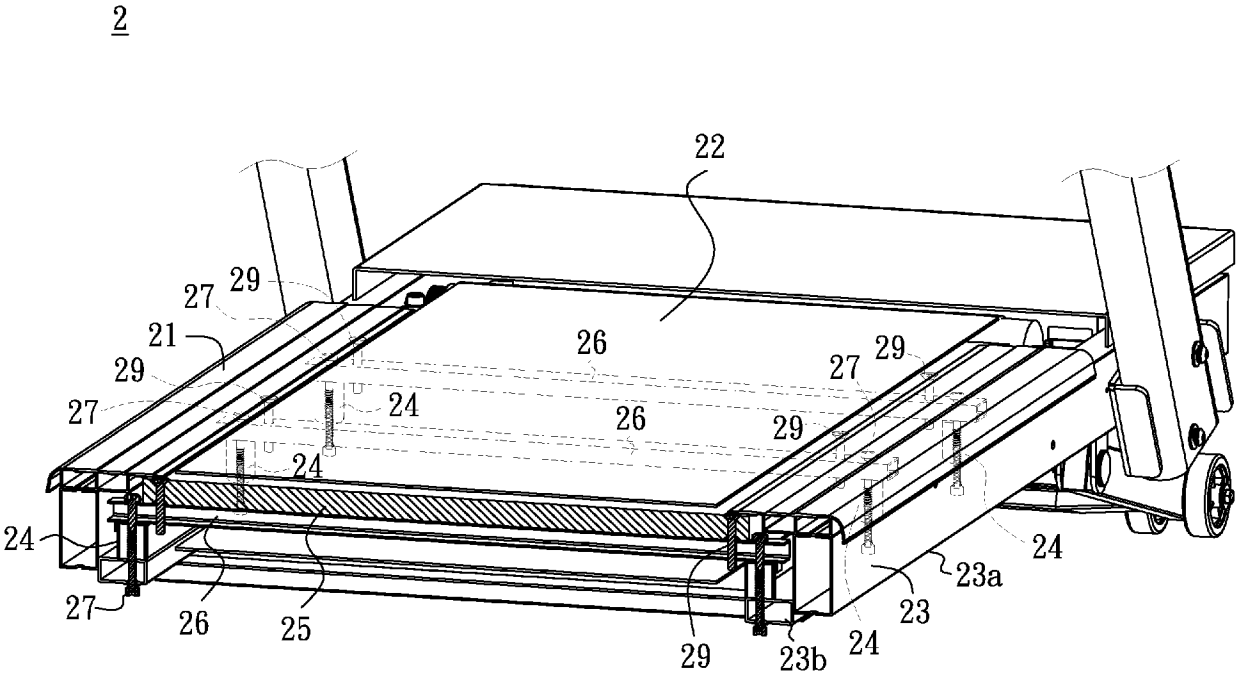
FIG. 2 is a partially enlarged cross-sectional view showing a flattened treadmill according to a preferred embodiment of the present invention.

FIG. 2 is a partially enlarged cross-section view showing a flattened treadmill 2 according to a preferred embodiment of this invention. As shown in FIG. 2, the flattened treadmill 2 comprises a conveyor belt 22 allowing a user to walk or run in the same place. Two decorating bars 21 are arranged at a right and a left side of the conveyor belt 22, respectively. The two decorating bars 21 are made of, but are not limited to, aluminum. A supporting plate 25 is arranged below the conveyor belt 22 to support the conveyor belt 22. The supporting plate 25 provides a buffer effect to absorb the force transmitted from the conveyor belt 22. Preferably, the supporting plate 25 is made of wood, composite wood, or wood-like material. The supporting plate 25 features in a narrower width than conventional plate 15, and a portion of each longitudinal side of the supporting plate 25 is covered by the two decorating bars 21, respectively. In particular, the covered portion of the supporting plate may be thinned, so that the conjunction between the decorating bars 21 and the supporting plate 25 is nearly flattened. In an embodiment, the covered portion of the supporting plate 25 is complementary to the decorating bars 21. For example, the covered portion of the supporting plate 25 has a trapezoid or triangular configuration matching a trapezoid or triangular configuration of the decorating bars 21. In addition, the treadmill 2 includes a frame 23 with two vertical portions 23*a* and two horizontal portions 23*b* arranged at the two sides of the conveyor belt 22, respectively. The horizontal portion 23*b* may be orthogonal to a lower end of the vertical portion 23*a*. In some embodiments, the horizontal portions may 23*b* be considered as independent components such as blocks 23*b* separated from the vertical portions 23*a*. A plurality of buffering pads 24 and a plurality of supporting rods 26 are arranged inside of the frame 23 and spaced at intervals. The horizontally arranged supporting rods 26 are below the supporting plate 25, and two buffering pads 24 are arranged below two ends of each supporting rod 26 respectively and two first fastening members 27 are used for fixing each end of each supporting rod 26 and each buffering pad 24. In this preferred embodiment, each of the buffering pads 24 is arranged between one end of the supporting rod 26 and the horizontal portion 23*b* (or the blocks 23*b*) of the frame 23, and the first fastening member 27 fixes the supporting rod 26, the buffering pad 24, and the horizontal portion 23*b* (or the blocks) of the frame 23.

In addition, the two ends of each supporting rods 26 are not fixed with the vertical portion 23*a* of the frame 23. Because the width of the supporting plate 25 is decreased, two second fastening members 29 are used to fix the supporting plate 25 with the two ends of each supporting rod 26, respectively. Preferably, the first fastening members 27 and the second fastening members 29 are screw/nut combination or the like components. According to the embodiment of this invention, the decorating bars 21 are arranged on the frame 23 and have much thinner thickness than the conventional configuration due to narrower supporting plate 25. Accordingly, the decorating bars 21 and the conveyor belt 22 have a same elevation.

Figure 3:
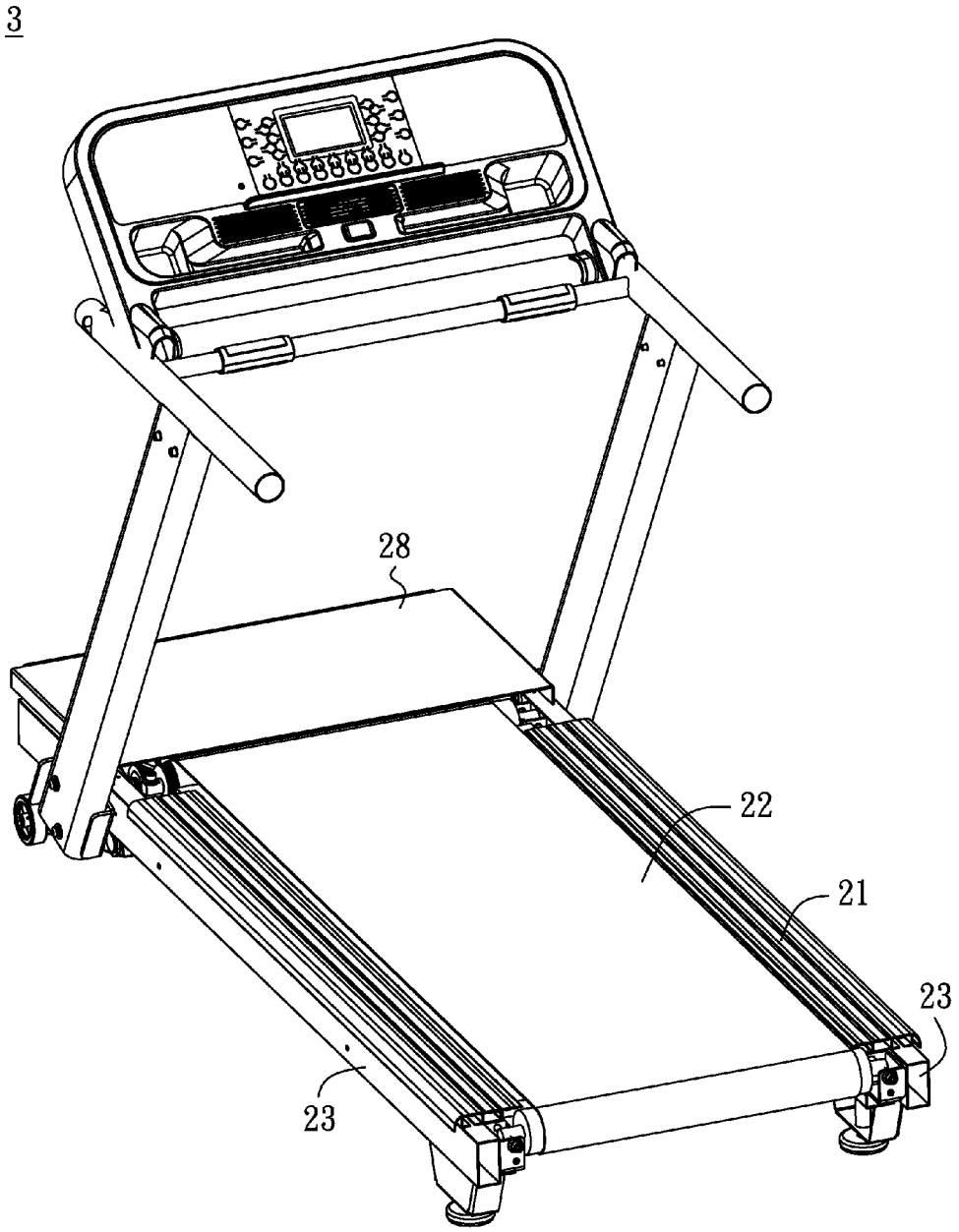
FIG. 3 is a front view showing a flattened treadmill according to another embodiment of the present invention.

FIG. 3 is a front view showing a flattened treadmill 3 according to another embodiment of this invention. The flattened treadmill 3 has same essential features as the flattened treadmill 2 disclosed in FIG. 2, i.e., the decorating bars 21 and the conveyor belt 22 having a same elevation. Furthermore, the flattened treadmill 3 includes a flat housing 28 with an elevation same as the elevation of the conveyor belt either.

Figure 4:
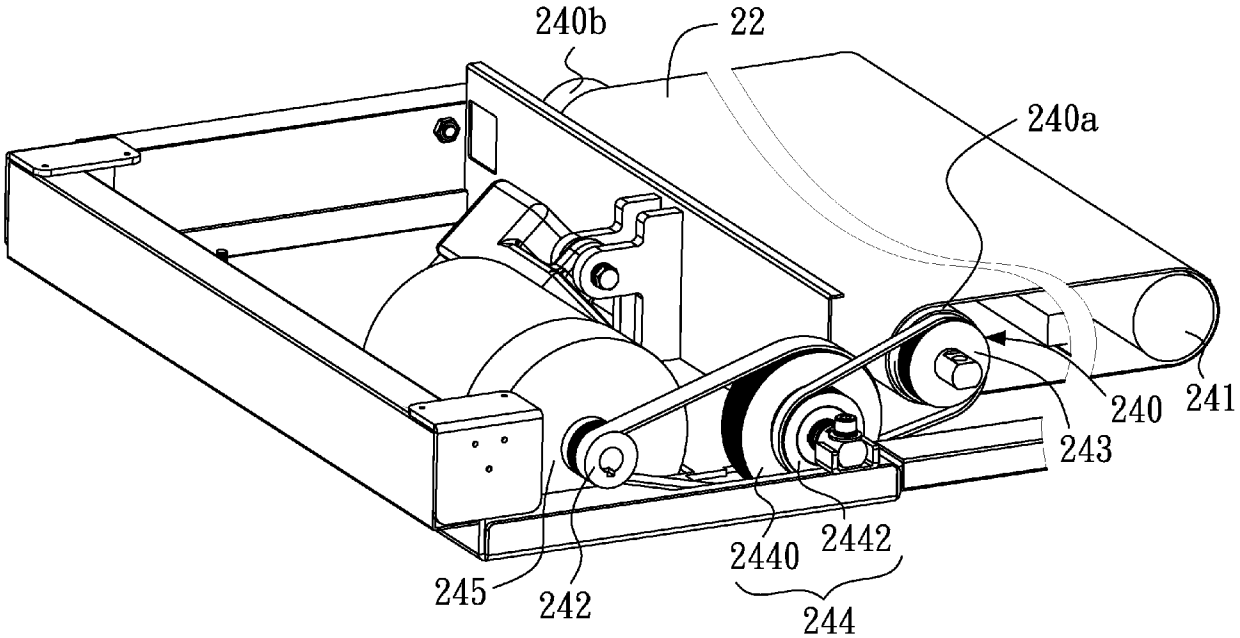
FIG. 4 is a partially enlarged view showing a flattened treadmill according to an embodiment of the present invention.

In this embodiment, the flat housing 28 is used to cover a motor and components of a driving system (not shown). The driving system drives the conveyor belt 22 to rotate. The detail of the driving system may refer to Taiwan patent application no. 102220537, entitled "flattened treadmill," the entire contents of this patent application are expressly incorporated herein by reference For example, referring to FIG. 4, the driving system may comprise a front roller 240, a rear roller 241, a first wheel 242, a second wheel 243, a medium wheel mechanism 244 (including a large wheel 2440 and a small wheel 2442), and a motor 245. The front roller 240 and the rear roller 241 are arranged under the conveyor belt 22 and are surrounded by the conveyor belt 22. The motor 245 is arranged near to the front end of treadmill 3, and the elevation of which is below the elevation of the conveyor belt 22. The first wheel 242 couples with the motor 245 and has an elevation below the elevation of the conveyor belt 22. The second wheel 243 is arranged at a first end of the front roller, and the diameter of the second wheel 243 is equal to or smaller than the diameter of the second end 240*b* of the front roller, so that the elevation of the second wheel 243 is equal to or below the elevation of the conveyor belt 22. The medium wheel mechanism 244 couples with the first wheel 242 and the second wheel 243. Whereby the motor 245 drives the first wheel 242 to rotate, the first wheel 242 drives the medium wheel mechanism 244 to rotate, and the medium wheel mechanism 244 drives the second wheel 243 and the front roller 240 to rotate and thus causing the rotation of the conveyor belt 22. The other features of the flattened treadmill 3 are same as the flattened treadmill 2 as shown in FIG. 2 and therefore are omitted.

Accordingly, embodiments of this invention provide flattened treadmills with narrower supporting plate 25 and thinner decorating bars 21 so as to save the material cost.

More importantly, embodiments of this invention provide flattened treadmills featuring in that the conveyor belt 22, the decorating bars 21, and even the flat housing all have a same elevation, i.e., a totally flattened configuration. Therefore, the safety of the user and the reliability of the treadmill are both significantly increased.

The intent accompanying this disclosure is to have each/all embodiments construed in conjunction with the knowledge of one skilled in the art to cover all modifications, variations, combinations, permutations, omissions, substitutions, alternatives, and equivalents of the embodiments, to the extent not mutually exclusive, as may fall within the spirit and scope of the invention. Corresponding or related structure and methods disclosed or referenced herein, and/or in any and all co-pending, abandoned or patented application(s) by any of the named inventor(s) or assignee(s) of this application and invention, are incorporated herein by reference in their entireties, wherein such incorporation includes corresponding or related structure (and modifications thereof) which may be, in whole or in part, (i) operable and/or constructed with, (ii) modified by one skilled in the art to be operable and/or constructed with, and/or (iii) implemented/made/used with or in combination with, any part(s) of the present invention according to this disclosure, that of the application and references cited therein, and the knowledge and judgment of one skilled in the art.

Conditional language, such as, among others, "can," "could," "might," or "may," unless specifically stated otherwise, or otherwise understood within the context as used, is generally intended to convey that embodiments include, and in other interpretations do not include, certain features, elements and/or steps. Thus, such conditional language is not generally intended to imply that features, elements and/or steps are in any way required for one or more embodiments, or interpretations thereof, or that one or more embodiments necessarily include logic for deciding, with or without user input or prompting, whether these features, elements and/or steps are included or are to be performed in any particular embodiment.

All of the contents of the preceding documents are incorporated herein by reference in their entireties. Although the disclosure herein refers to certain illustrated embodiments, it is to be understood that these embodiments have been presented by way of example rather than limitation. For example, any of the particulars or features mechanism out or referenced herein, or other features, including method steps and techniques, may be used with any other structure(s) and process described or referenced herein, in whole or in part, in any combination or permutation as a non-equivalent, separate, non-interchangeable aspect of this invention. Corresponding or related structure and methods specifically contemplated and disclosed herein as part of this invention, to the extent not mutually inconsistent as will be apparent from the context, this specification, and the knowledge of one skilled in the art, including, modifications thereto, which may be, in whole or in part, (i) operable and/or constructed with, (ii) modified by one skilled in the art to be operable and/or constructed with, and/or (iii) implemented/made/used with or in combination with, any parts of the present invention according to this disclosure, include: (I) any one or more parts of the above disclosed or referenced structure and methods and/or (II) subject matter of any one or more of the inventive concepts mechanism forth herein and parts thereof, in any permutation and/or combination, include the subject matter of any one or more of the mentioned features and aspects, in any permutation and/or combination.

Although specific embodiments have been illustrated and described, it will be appreciated by those skilled in the art that various modifications may be made without departing from the scope of the present invention, which is intended to be limited solely by the appended claims.

What is claimed is:

1. A flattened treadmill, comprising:

a conveyor belt allowing a user to walk or run in the same place;

two decorating bars being arranged at a right and a left side of the conveyor belt respectively and having an elevation same as an elevation of the conveyor belt;

a supporting plate being arranged below the conveyor belt to support the conveyor belt, a portion of a left longitudinal side and a portion of a right longitudinal side of the supporting plate being covered by the two decorating bars respectively, wherein the two covered portions of the supporting plate is thinned, so that the conjunction between the two decorating bars and the supporting plate is flattened;

a frame, on which the two decorating bars are arranged, the frame comprising two vertical portions and two horizontal portions, wherein each one of the two vertical portions is parallel with one of the two decorating bars and is arranged below the corresponded decorating bar for supporting the corresponded decorating bar, and each one of two horizontal portion is orthogonal to a lower end of one corresponded vertical portion;

a plurality of supporting rods being horizontally spaced at intervals below the supporting plate and inside of the frame;

a plurality of buffering pads being arranged below the plurality of supporting rods;

a plurality of first fastening members, each first fastening member fixing one end of one of the plurality of the supporting rods, one of the buffering pads, and one of the two horizontal portions of the frame; and a plurality of second fastening members, each second fastening member fixing the supporting plate and one of the supporting rods.

2. The flattened treadmill of claim 1, wherein the supporting plate is made of wood or composite wood.

3. The flattened treadmill of claim 1, wherein the supporting rods are not fixed with the vertical portion of the frame.

4. The flattened treadmill of claim 1, wherein the two decorating bars are made of aluminum.

5. The flattened treadmill of claim 1, wherein the first fastening members and the second fastening members comprise screw and nut.

6. The flattened treadmill of claim 1, further comprising a flat housing arranged at an end of the flattened treadmill and having an elevation same as the elevation of the conveyor belt.

7. The flattened treadmill of claim 6, wherein the flat housing covers at least some components of a driving system.

8. The flattened treadmill of claim 7, wherein the driving system comprises:

a front roller being arranged under the conveyor belt and being surrounded by the conveyor belt;

a motor being arranged in front of the conveyor belt and having an elevation equal to or under an elevation of the conveyor belt;

a first wheel coupled with the motor, the first wheel having an elevation equal to or under the elevation of the conveyor belt;

a second wheel arranged at a first end of the front roller, the second wheel having a diameter equal to or smaller than a diameter of a second end of the front roller;

at least a medium wheel mechanism coupled with the first wheel and the second wheel; whereby the motor drives the first wheel to rotate, the first wheel drives the medium wheel mechanism to rotate, and the medium wheel mechanism drives the second wheel and the front roller to rotate and thus causing the rotation of the conveyor belt.

* * * * *